United States Patent [19]

Weisgerber

[11] Patent Number: 5,056,773

[45] Date of Patent: Oct. 15, 1991

[54] SHEET DELIVERER

[75] Inventor: Willi Weisgerber, Geisenheim-Johannisberg, Fed. Rep. of Germany

[73] Assignee: Miller-Johannisberg Druckmaschinen GmbH, Geisenheim, Fed. Rep. of Germany

[21] Appl. No.: 548,499

[22] Filed: Jul. 3, 1990

[30] Foreign Application Priority Data

Nov. 28, 1989 [DE] Fed. Rep. of Germany ..... 3939250

[51] Int. Cl.[5] ..... B65H 29/04

[52] U.S. Cl. ..... 271/204; 271/277; 198/841; 198/814

[58] Field of Search ..... 198/841, 838, 814, 607, 198/803.7, 803.9; 221/217, 218; 271/7, 277, 198, 204, 205, 82, 206

[56] References Cited

U.S. PATENT DOCUMENTS

| | | | |
|---|---|---|---|
| 2,414,164 | 1/1947 | Nalbach | 198/814 |
| 2,969,870 | 1/1961 | Pulver | 198/814 |
| 3,826,486 | 7/1974 | Abendroth | 271/204 |
| 4,083,556 | 4/1978 | Schilling et al. | 271/204 |
| 4,479,645 | 10/1984 | Pollich | 271/204 |
| 4,693,362 | 9/1987 | Kemmer et al. | 271/204 |

FOREIGN PATENT DOCUMENTS

| | | | |
|---|---|---|---|
| 727890 | 10/1942 | Fed. Rep. of Germany | 198/814 |
| 3323953 | 4/1984 | Fed. Rep. of Germany | 271/204 |

*Primary Examiner*—H. Grant Skaggs

*Attorney, Agent, or Firm*—Carothers & Carothers

[57] ABSTRACT

A sheet deliverer apparatus for a sheet processing machine, particularly a sheet printing machine with a high stapling or stacking sheet delivery capability, wherein sheet deliverer upper and lower chain guide ways extend in the same direction of curvature, and a clamping device is provided to clamp the sheet deliverer chains in tension to provide very even and silent running of the sheet deliverer chains and the gripping pads, extended service life and uniform sheet travel free of flutter over the complete conveying way to the delivery staple or table or permit increased conveying output.

10 Claims, 2 Drawing Sheets

1
2
3
4
5
6
7
9
10
22
23
24
25
28
29
30
31
32
33
34
35
Z
III
III

SHEET DELIVERER

BACKGROUND OF THE INVENTION

This invention relates to a sheet deliverer for a sheet processing machine, particularly a sheet printing machine with high stapling or stacking delivery in which the sheets are taken off the machine by means of controlled gripper pads carried on orbitally moveable chains (e.g., roller chains), and are conveyed thereby to a stapling or stacking table upon which the sheets are delivered and stapled (i.e., stacked) to a high staple, wherein a plurality of the gripping pads are disposed parallel to each other in laterally spaced relation and are fastened to the respective laterally spaced rotating or orbiting chains which travel in chain guides with upper and lower guide flanks, and wherein the chain guides are guided at the input and the output sides of the sheet deliverer over reversing guides or wheels, and the chain guides extend at least from an input reversing guide to the upper side of the stapling table.

Sheet deliverers having the above described features are known in numerous embodiments. They all are arranged such that the chain guide way forms a generally Z-like or S-like path of travel for the chains in side view, which constrains the chains guided thereby to proceed through repeated changes of direction in their traverse of the chain guides. One example of such an apparatus is disclosed in German patent specification 23 08 025.

A different prior art sheet deliverer described in German patent specification 25 44 566 also provides in the lower and upper chain guide ways several changes of direction of chain movement including straight or flat chain runs where the chain is not positively engaging either the upper or lower guide way flanks. In addition, this German patent also describes a sheet guiding plate provided at a small distance below the lower chain guide way and parallel to it, with the sheet guiding plate extending approximately to the front edge of a stapling table. In operation, this sheet guiding plate provides between itself and the sheets conveyed an air cushion which assists in the uniform transport of the sheets and prevents the sheets from having contact with the guide plate.

With such a Z-like or S-like course of a chain guide way as disclosed by the prior art, each change of direction of the chain guide way forces the rolls of the roller chain elements to move from engagement with one guide surface or flank to engagement with an opposed guide surface or flank, with resultant loud noise development in moving from engagement with one guide flank to the other, for instance from a lower chain guide flank to an upper chain guide flank or vice versa. This effect is caused by the inertia of the moving chain mass and the changing centrifugal forces resulting when changing the direction of chain travel, the chain inertia being even greater at points where the gripping pads, which have a considerable mass themselves, are fastened to the chains. Tension imposed on the chains during changing of engaging flanks of the chain guides in the areas where the direction of chain travel changes also can result in considerable noise.

Another disadvantage of prior sheet deliverers is that the mentioned direction changes of the orbitally traveling chains in the Z-like or S-like chain guide ways leads to a wave-like, flag-fluttering movement of the sheets being transported by the gripping pads. This hinders system operating efficiency, particularly when the sheets are printed on both sides, because such fluttering may cause undesired smearing of the freshly printed sheets by their repeated forceful contacting the sheet guides.

After a certain duration of such operation, the repeated change of contact guide flanks and the chain roller elements within the guides leads to premature wear or damage of both the chain rollers and the chain guides, and this results in even greater noise development. Consequently, in a sheet deliverer according to the prior art delivery speed is limited in order to avoid the described disadvantages. In the future, however, sheet deliverers will be needed that can convey or deliver sheets at higher speeds that conventional sheet deliverers due to increasing printing press operating speeds and output.

BRIEF SUMMARY OF THE INVENTION

It is therefore one object of the present invention to provide a sheet deliverer of the type characterized hereinabove with structural improvements such as to considerably extend the service life of the chain elements and the structural parts and in particular of the cooperating chain guides, and wherein during operation of the apparatus noise development is also considerably reduced, particularly after a longer duration of operation in which higher operational speeds are possible. Also, the sheets are conveyed from a pressure cylinder of a previous machine to the stapling (i.e., stacking) table in uniform fashion without fluttering, which is the most substantial stipulation for a higher conveying capacity per time unit.

To provide for this object, the invention is characterized by upper and lower chain guide ways between respective upper and lower transition points at the respective chain reversing guides. The respective chain guide ways describe curves which, over the entire extent of the respective chain guide ways, have the same direction of curvature. Additionally, a clamping device is provided to tension the chains thereby pressing all the chain members with their rollers onto one and the same flank of the respective chain guide ways over the entire length of the respective chain guide ways.

The chains therefore are guided throughout their entire travel between reversing guides without any changes of direction whereby the described disadvantages of the prior art are avoided. The rollers of the chain thus travel in spaced relation with respect to the upper flanks of the respective chain guides, and in engagement with the lower flanks of the respective chain guides. The upper chain guide flanks therefore serve only as a safety feature to prevent flying out of the chains and the gripping pads as a result of foreign matter contamination in the chain guides or other possible causes.

It is to be emphasized that because of the described profile of the chain guide ways and the tension maintained on the chains, the chain rollers always engage only one flank, namely the lower guide flank of the chain guide for the disclosed preferred embodiments, and the rotary direction of the chain roller rotation remains the same over the entire traverse of the lower and upper chain guide ways. A change in the direction of rotation of the chain rollers, as occurs in the prior art devices when the chain moves through a change of direction, is no longer present, and the accompanying disadvantages thus are also avoided. In particular, there is no longer any tendency toward removal of the lubricating film between the chain rollers and the flanks of the chain guides, which lubricant removal has been one cause of damage in prior art devices. Additionally, with the present invention, beating of the chains against the guide flanks no longer occurs, as the engagement of the chain rollers does not change from the lower flank to the upper flank of the chain guides or vice versa. The mass of the gripping pads, being thus subject to smoother motion concomitant with the chain motion, also is less likely to contribute to the problems experienced in the prior art devices. The accompanying noise problems also are avoided and all these benefits together enable a much higher operating speed.

Preferably, a sheet guiding plate or the like is also provided closely spaced below and parallel to the lower chain guide way, and extending approximately up to the front edge of the stapling table. Such a guiding plate is known per se from the cited prior art, although not in conjunction with a structure according to the present invention. Preferably, an air cushion is provided between the sheet guiding plate and the sheets being conveyed closely above the same whereby undesirable fluttering of the sheets and smearing of fresh print on the sheets during conveying thereof is avoided.

The above and further objects and advantages of the invention are explained in the following detailed description, with reference to the accompanying drawings, in which.

The invention is described below with reference to a sheet printing machine with high stapling delivery; however, it is also applicable to sheet processing machines generally which preferably have a high stapling (i.e., stacking) delivery because here the problems apparent in the prior art and described above are most prevalent. The invention also can be applied to such sheet processing machines with flat stapling delivery.

Figure 1:
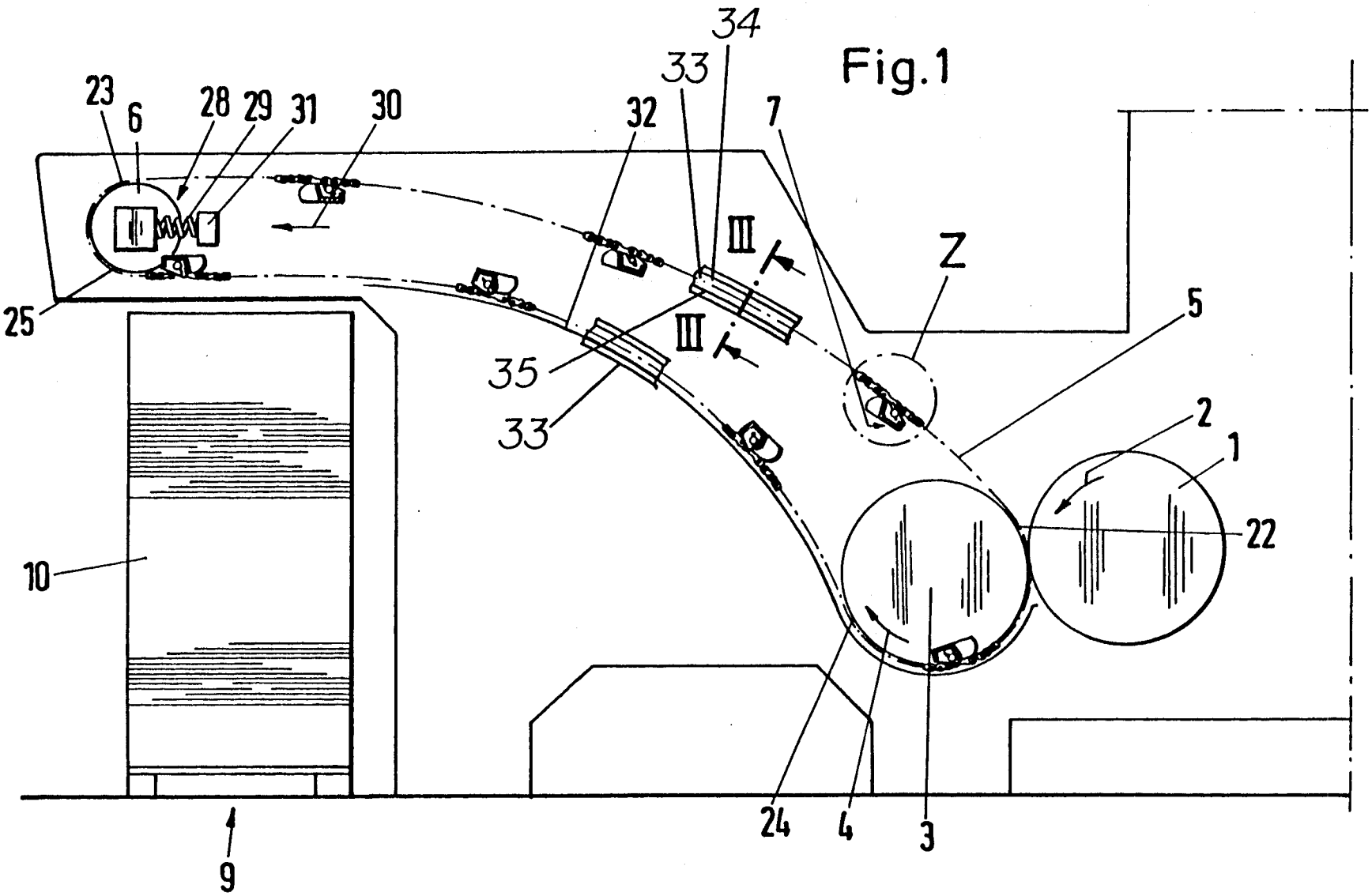
FIG. 1 is a schematic side elevation of a sheet deliverer according to one presently preferred embodiment of the instant invention.

In FIG. 1, sheets printed on one or both sides are taken off a pressure cylinder 1 rotating in the direction indicated by arrow 2 and are transmitted to a front reversing guide of a sheet deliverer. In the embodiment shown, the front reversing guide comprises a pair of laterally spaced chain wheels 3, only one of which appears in FIG. 1. Different known reversing guides are suitable for use with this invention. The chain wheels 3 rotate in the direction indicated by arrow 4.

A pair of endless roller chains 5 extend about the respective front chain wheels 3 and about a respective pair of rear chain wheels 6 which are rear reversing guides for the chains 5. As with chain wheels 3, the chain wheels 6 are spaced laterally apart and only one shows in FIG. 1, just as only one of chains 5 shows in FIG. 1. In general then, the chain and guide structure shown in FIG. 1 is identical to another such structure which is spaced laterally from it. The description of one such structure hereinbelow is intended to apply to both.

Several gripping pad assemblies 7 are fastened to chains 5 at spaced intervals. Such gripping pad assemblies are further explained below with reference to FIG. 2. The controlled gripping pad assemblies 7 take the sheets off pressure cylinder 1 and release them over a stapling table 9 so that the sheets are delivered on the delivery table to form a sheet stack or staple 10.

Figure 2:
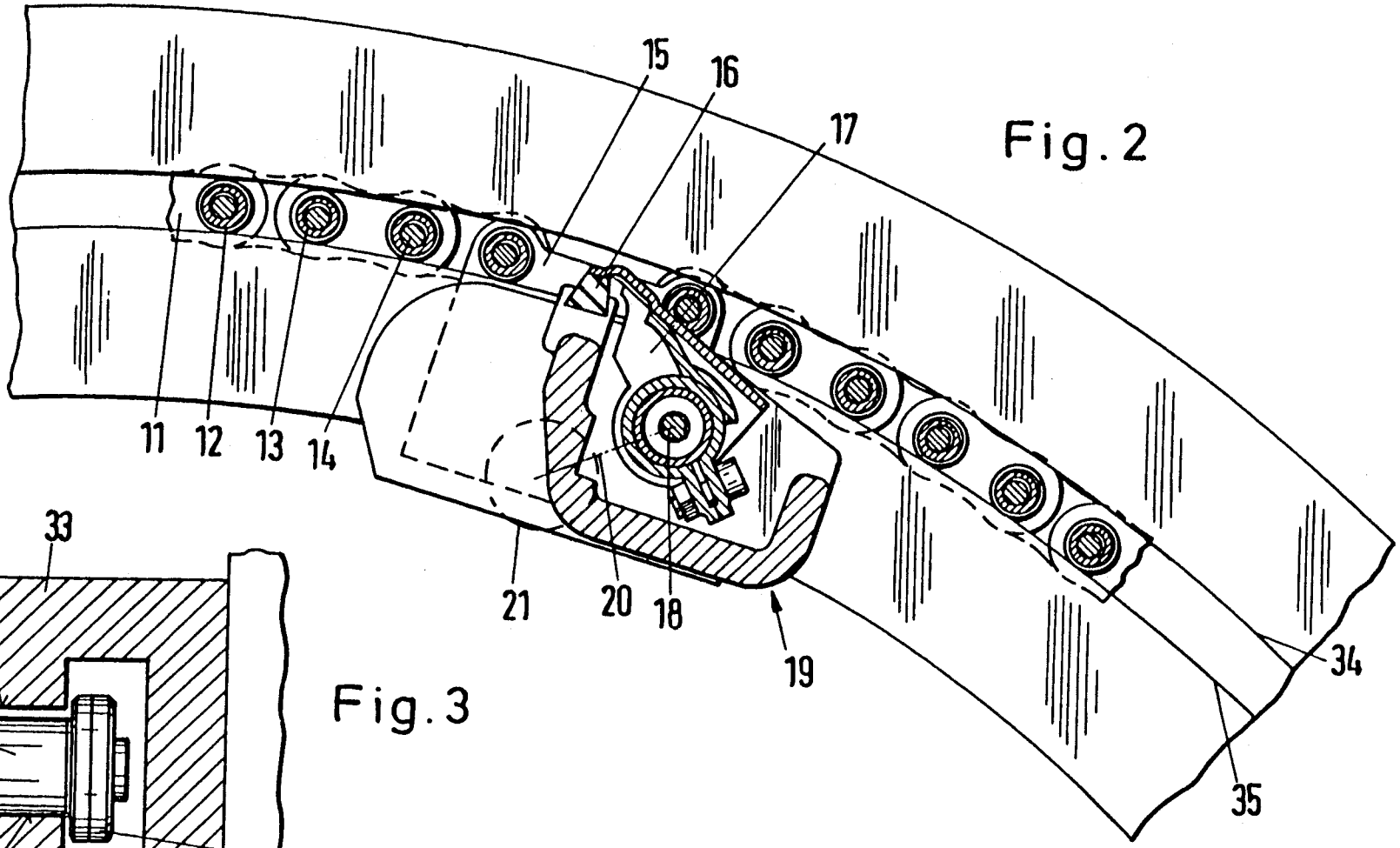
FIG. 2 is an enlarged detailed illustration of a fragmentary portion of FIG. 1.

As shown in FIG. 2, chains 5 comprise conventional roller chains including chain side bars 11 preferably having uniform length, rollers 12, axial sockets 13 formed in rollers 12, and chain pins 14 extending axially within sockets 13. The gripping pads 7 are secured with respect to the chains 5 by special chain side bars 15 which in the embodiment shown have a length twice that of the chain side bars 11 so that the rotary axes of a pair of rollers 12 associated with a special side bar 15 are spaced apart by twice the distance of spacing for the adjacent rollers 12 associated with any chain side bar 11.

Gripping pad assemblies 7 include gripping supports 16, and respective grippers 17 actuated by torsion springs 18 to engage the grippers 17 upon gripping supports 16.

The grippers 17 are actuated to close at that point where a sheet is to be taken off the cylinder 1 and again to open at that point where the sheet is to be delivered on delivery table 9. A lever 20 carries a roll 21, which roll 21 is actuated by a fixed gripper opening curve or cam (not shown) that may preferably be an adjustable cam.

In FIG. 1 there is also shown a front upper transition point 22 between the front chain wheels 3 and the upper run of the chains 5, and also a rear upper transition point 23 between the rear chain wheels 6 and the upper run of the rotating chains 5. Moreover, a front, lower transition point 24 is located between the front chain wheels 3 and the lower run of the rotating chains 5, and a rear, lower transition point 25 is located between the rear chain wheels 6 and the lower run of the rotating chains 5. These transition points generally mark the ends of the respective guideways 33.

Figure 3:
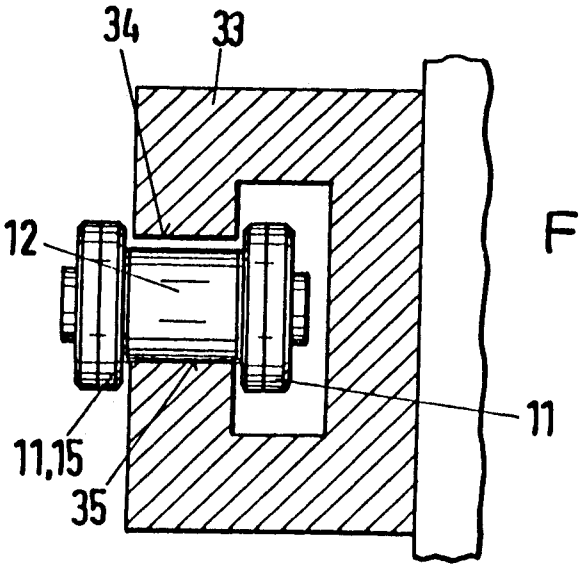
FIG. 3 is a sectional view taken on line III—III of FIG. 1.

The chains 5 are guided in predetermined paths between the respective pairs of upper and lower transition points by upper and lower chain guides 33, the location of which can be seen from FIG. 1 and the construction of which can be seen from FIG. 3 in detail. Each chain guide 33 is comprised of a generally C-profile section of rigid, curved track which thereby provides an upper curved chain guide flank 34 and a lower curved chain guide flank 35. In the openings of the C-profile track for both the upper and the lower chain guide ways 33, between the guide flanks 34 and 35 thereof, the respective upper and lower runs of chains 5 with their chain rollers 12 travel in spaced relation to the upper guide flanks 34.

The entire curved path of the chain guide ways 33 between the transition points 22, 23 of the upper chain run, and the transition points 24, 25 of the lower chain run, curve continuously in the same direction. That is, in the view of FIG. 1, both chain guides 33 are curved substantially upwardly throughout their entire longitudinal extent. Thus, only at transition points 24 and 25 do the chains 5 change the direction of curvature of their travel.

Also shown in FIG. 2 is a clamping and tensioning device 28 which maintains the chains 5 clamped in tension. In the embodiment shown, a pressure spring 29 is provided which is supported with respect to a fixed abutment 31 to urge the rear chain wheel pairs 6 in the direction indicated by arrow 30 and thereby clamp the chains 5 in such a way that the rollers 12 of the chain members are continuously urged into engagement with the lower guide flank 35 of the chain guides 33 throughout the travel between the respective pairs of transition points 22, 23 and 24, 25. Accordingly, the rotary direction of the chain rollers does not change, and as a result an especially soft, smooth and quiet running of the chains with their gripping pads 19 (which have a considerable mass) is achieved.

Moreover, in FIG. 1 a sheet guiding plate 32 is shown extending below the front chain wheels 3 and approximately up to the delivery staple 10. The functioning of the sheet guiding plate 32 is uniformzed by an air cushion between the same and the conveyed sheets so that sheets are conveyed without undesirable fluttering.

As noted, accordingly to the invention the upper chain guide way between the transition points 22 and 23, and the lower chain guide way between the transition point 24 and 25 both describe curves which over the entire length of the respective upper and lower chain guide ways have a constant direction of curvature.

According to the description hereinabove I have invented a novel and improved sheet deliverer apparatus including chain guide way means which guide the upper and lower runs of an endless conveying chain that carries gripper elements in a path that curves continuously in a uniform direction whereby changes of direction of the upper and lower chain runs during traverse thereof between opposed reversing guides are completely avoided and the guiding of the respective upper and lower chain runs is achieved by continuous contact between contact elements such as roller elements of the chain with a guide surface or flank located to the radially inner side of the curved path. Of course, I have envisioned various alternative and modified embodiments of the invention and such would certainly also occur to others versed in the art once apprised of my invention. Accordingly, it is intended that the invention be construed broadly and limited only by the scope of the claims appended hereto.

I claim:

1. In a sheet deliverer for use with a sheet processing machine such as a sheet printing machine with high stapling delivery in which controlled gripping pads take sheets off a cylinder (1) of such a machine and convey them to a stapling table (9) upon which the sheets are delivered and stapled to a high staple (10), the improvement comprising:

said gripping pads being spaced along a pair of endless, laterally spaced, orbitally moveable chains (5) and being fastened at their ends on both sides of said orbiting chains (5), said chains (5) traveling in chain guides (33) with upper and lower guide flanks (34, 35) wherein said chains (5) are guided at the input and at the output sides of said sheet deliverer over front and rear reversing guides (3, 6), and said chain guides (33) extend between said input and output reversing guides (3, 6) adjacent the upper side of such a stapling table (9), and wherein said chain guides have upper and lower chain guide ways extending between pairs of transition points (22, 23; 24,25) at the respective reversing guides (3, 6), said chain guide ways describing curves which over the entire extent of the respective chain guides extend in the same direction of curvature, and a clamping device (28) which urges said chains continuously into engagement with only one guide flank of the respective chain guide ways throughout their travel within the respective chain guide ways.

2. The improved sheet deliverer according to claim 1 wherein a sheet guiding plate (32) is provided at a small distance below and parallel to said lower chain guide way, said plate extending adjacent a front edge of said stapling table (9).

3. In a sheet deliverer apparatus adapted for delivering sheet form articles such as printed sheets from a sheet processing machine such as a printing press to an assembly apparatus such as a stapling table, the combination comprising:

a pair of spaced apart reversing means carried by said sheet deliverer apparatus and adapted to carry an elongated endless conveying means;

at least one elongated endless conveying means carried by said pair of reversing means for orbital movement thereon;

said conveying means including at least one elongated run which extends between said pair of reversing means;

guide means extending between said pair of reversing means, said guide means having an elongated guide surface which curves continuously in a single direction of curvature to define a curved path extending between said pair of reversing means;

said guide means being disposed for engagement of said guide surface with substantially the entire longitudinal extent of said at least one run of said conveying means to guide said at least one run for travel in said curved path between said pair of reversing means; and tensioning means cooperable with at least one of said reversing means to maintain said at least one run in tension and in biased engagement with said guide surface throughout movement of said at least one run between said pair of reversing means.

4. The combination as set forth in claim 3 wherein said guide means includes a pair of spaced apart, opposed, coextensive guide surfaces.

5. The combination as set forth in claim 4 wherein said at least one run of said conveying means is confined between said opposed guide surfaces.

6. The combination as set forth in claim 5 wherein said tensioning means is cooperable with said guide means to maintain said at least one run of said conveying means in contact with only one of said opposed elongated guide surfaces throughout movement of said at least one run between said pair of reversing means.

7. The combination as set forth in claim 6 wherein said conveying means is a roller chain means having plural spaced apart rollers and said rollers of the portion of said chain means in said at least one run are maintained in contact with said one of said opposed elongated guide surfaces throughout movement of said at least one run between said pair of reversing means.

8. The combination as set forth in claim 7 wherein said guide means is an elongated C-channel section member having a closed side and an open side which defines an elongated opening and said opposed elongated guide surfaces are disposed in confronting relation on said open side to form respective upper and lower extents of said elongated opening.

9. The combination as set forth in claim 8 wherein said at least one run is confined within said elongated opening between said opposed elongated guide surfaces.

10. The combination as set forth in claim 9 additionally including gripper means carried by said chain and moveable in orbital movement therewith.

* * * * *